US005431552A

United States Patent [19]

Schuller et al.

[11] Patent Number: 5,431,552

[45] Date of Patent: Jul. 11, 1995

[54] VANE PUMP

[75] Inventors: Ronald A. Schuller, Tulsa; Alan P. Tietenbrun, Oklahoma City; James J. Davis, Moore; Michael F. Hughes, Oklahoma City; James D. Gray, Bethany; Michael W. Spidell, Oklahoma City, all of Okla.

[73] Assignee: Corken, Inc., Oklahoma City, Okla.

[21] Appl. No.: 189,664

[22] Filed: Feb. 1, 1994

Related U.S. Application Data

[63] Continuation of Ser. No. 997,588, Dec. 28, 1992, abandoned.

[51] Int. Cl.[6] ..... F04C 2/00

[52] U.S. Cl. ..... 418/150; 418/15; 418/268

[58] Field of Search ..... 418/150, 260, 268, 15; 464/178, 182

[56] References Cited

U.S. PATENT DOCUMENTS

| | | | |
|---|---|---|---|
| 2,165,963 | 7/1939 | Curtis | 418/150 |
| 3,392,677 | 7/1968 | Kennedy | 418/107 |
| 4,659,298 | 4/1987 | Byram et al. | 418/253 |
| 4,737,090 | 4/1988 | Sakai et al. | 418/150 |
| 4,746,280 | 5/1988 | Wystemp et al. | 418/268 |
| 4,765,688 | 8/1988 | Hofmann et al. | 464/178 |
| 4,830,593 | 5/1989 | Byram et al. | 418/253 |

FOREIGN PATENT DOCUMENTS

| | | | |
|---|---|---|---|
| 3824882 | 1/1990 | Germany | 418/150 |

OTHER PUBLICATIONS

"Kent's Mechanical Engineers Handbook", by J. Kenneth Salisbury, Wiley Engineering Handbook Series, 1950, pp. 5-66 & 5-67.

Corken Drawing Cam Model T700, Part No. 4060A, Sep. 1988.

Corken Drawing Cam Model 700, Part No. R4060, Apr. 1988.

Corken Drawing Cam Model 700, Part No. 1849-1H, Nov. 1977.

Corken Drawing Cam Model 700, Part No. 1849-1N, Mar. 1988.

*Primary Examiner*—Richard A. Bertsch
*Assistant Examiner*—Charles G. Freay
*Attorney, Agent, or Firm*—Hill, Steadman & Simpson

[57] ABSTRACT

A sliding vane pump having an inside liner with a constant radius pump arc and a constant radius stop arc, connected together by cycloidal arcs. The liner has inlet slots arranged extending around a perimeter of a liner extending into the pump arc for maximum filling of the pumping volume. A herringbone-shaped slot arrangement is provided on a outlet side which increases vane life, increases sealing around the vanes on the outlet side, and decreases liner wear. A relief/fill porting arrangement is provided to pressurize the fluid in the pump chamber, or alternately to relieve pressure from the pump chamber. An improved thrust absorber is described particularly useful for truck mounting of the pump. An asymmetrical inside profile for the liner assists in pump operation by providing a fluid mathematical profile which approaches zero acceleration forces at the point of tangency.

35 Claims, 7 Drawing Sheets

FIG. 3
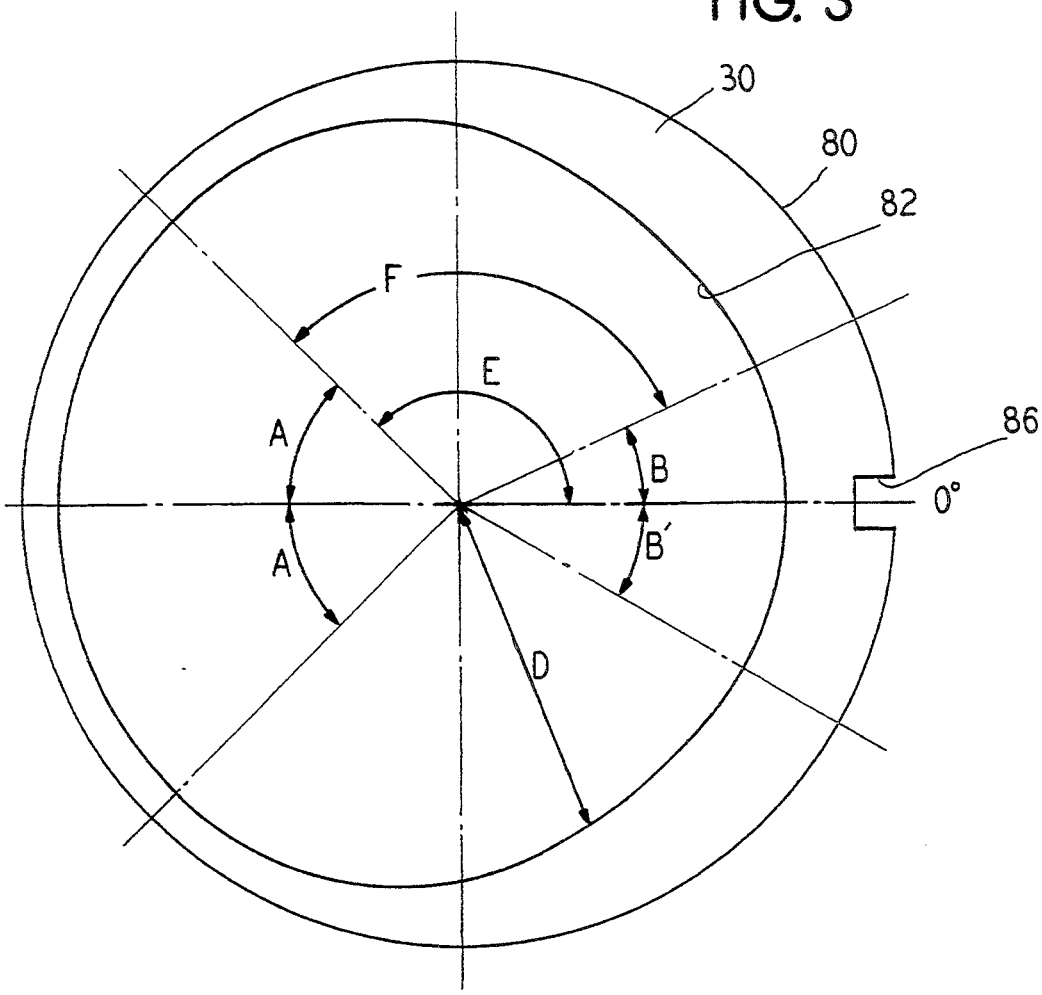
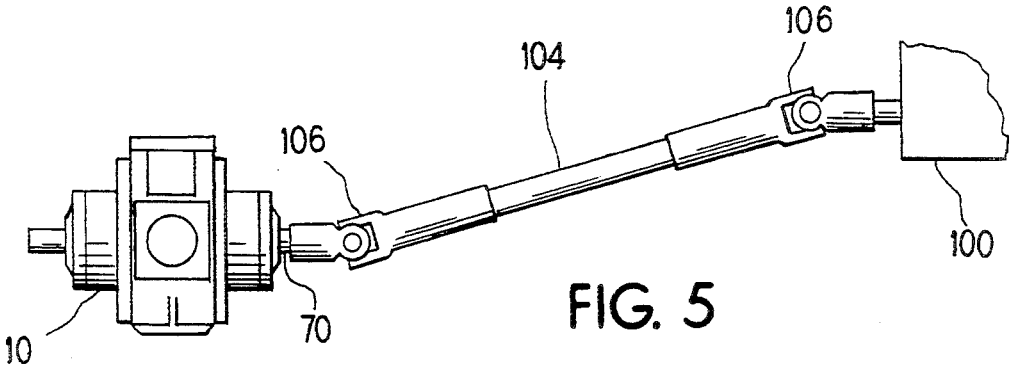
FIG. 5

VANE PUMP

This is a continuation of application Ser. No. 07/997,588, filed Dec. 28, 1992, now abandoned.

BACKGROUND OF THE INVENTION

The present invention relates to rotary vane pumps or sliding vane pumps. More particularly, the present invention relates to an improved cam arrangement having advantageously configured inlet and outlet openings, a mathematical non-symmetrical cam profile, a fluid energizing port arrangement, and an improved thrust absorber, and other improvements.

Sliding vane pumps are disclosed in U.S. Pat. No. 4,746,280 and 4,830,593. In a sliding vane pump the pump casing can include a stationary liner having an inner surface eccentric with respect to an axis of a rotor held within. A plurality of radial slots are arranged in the rotor which hold, in each slot, a vane slidably extendable and retractable therein. Around the periphery of the liner are arranged, in select regions, inlet openings and outlet openings. The fluid enters the inlet openings and is trapped between the rotor and the liner between adjacent moving vanes. The fluid is then moved around the interior of the liner with the rotating rotor until the fluid is passed through the outlet openings. The vanes or blades must be strategically biased radially outward either by springs or, in some cases, hydraulic pressure of the fluid being pumped.

Vane pumps are particularly useful in pumping fluids which are close to their boiling temperature at pressure, i.e., where very low suction head is available. In these applications, cavitation is a problem with its corresponding vibration and noise. Cavitation is commonly encountered during the liquid transfer of high vapor pressure products (boiling liquids) such as liquified petroleum gasses and ammonia. Such products, when transferred from one container to another, will boil (liquid/vapor transformation) in the pump inlet and pump chamber when the internal suction pressure is no longer at equilibrium. The liquid to vapor formation change can be caused by (1) the physical transfer of product from one closed vessel to another, or (2) the absence of a vapor equalizing line which allows vapor pressure between tanks to equalize and reduce or eliminate the liquid/vapor transformation (boiling) during transfer.

A high vapor pressure product, as described above, when being transferred (pumped) via piping, easily experiences phase changes, from liquid to vapor and back to liquid, resulting in the pump having to operate with a liquid/vapor mix. This mixture can cause internal moving parts, such as vanes, to become unstable because of incomplete filling of the pumping chamber with liquid.

An additional problem with prior art pumps is that the drive for the pump, when used in a truck loading operation, comprises a power take off shaft from the transmission which is rotationally driven elevationally offset from the axis of the pump. A drive shaft with U joints or knuckle joints is needed to couple the take off shaft to the pump shaft. This has a tendency to transmit axial movement of the drive shaft to the pump shaft or a bending moment on the pump shaft because of the offset.

SUMMARY OF THE INVENTION

The present invention relates to an improved sliding vane pump having an improved "liner" or "cam" design to reduce the effects of vapor mix due to boiling in the pumping chamber. The inventive cam design enables the vanes to remain more positively actuated during the pumping operation, thereby increasing pump efficiency while reducing system noise and vibration. The present invention further helps reduce an effect similar to "water hammer" at an outlet end of the pump wherein the vanes open up to an outlet exposed to liquid of an increased pressure.

The liner of the present invention provides a cam surface with respect to the axis of the rotor. The cam surface provides two circular regions, a pump arc having a maximum radius with respect to the rotor axis and a stop arc having a minimum radius with respect to the rotor axis, and two cycloidal arcs connecting the pump arc and the stop arc at "points of tangency".

Slotted inlet ports are elongated in the moving direction of the vanes and terminate at a predetermined point that optimizes the minimum net positive suction head requirements of the pumping chamber. This relationship is speed dependent.

The "pumping chamber" is defined as the region within the pump arc at the point when the two moving vanes close the pump arc from the inlet port(s) and the outlet port(s). Location of the point at which the trailing vane closes the pumping chamber from the inlet port is important. It is advantageously located such that the vane has reached full extension for complete filling of the pumping chamber. The inlet port or ports are located communicating through the cam located in one cycloidal arc and partially extending into the circular pump arc. Pump efficiency, operation and quietness are improved by revising the inlet/outlet cam port openings from holes to slots. Holes at the inlet can act as orifices and produce increased pressure drops, which promote liquid/vapor "flash".

As the two vanes continue to rotate, the pumping chamber is opened to the discharge ports and the liquid contained in the pumping chamber is moved through the discharge ports into the downstream piping. The fluid is thus discharged as the pumping chamber volume decreases with the cam profile as the vanes are retracted into their slots.

The preferred cam design is a non-symmetrical (inlet to outlet) design, which offers better liquid loading of the vanes during rotation.

The cam profile utilized in the present invention is non-symmetrical as the profile is generated through the two areas of constant radius, the stop arc, and the pump arc. The curves connecting the stop arc and pump arc are developed dependent on the size geometry and required fluid flow capacity. The cam is configured to produce an optimal fluid volume ahead of the pumping chamber that will be swept in by the vane. The stop arc and the pump arc are unequally allocated on opposite sides of a centerline taken through the keyway. This centerline approximates the sealing axis through the pump that separates the upstream and downstream pressures (differential pressures) produced by the fluid volume being transferred.

A pressure differential dependent upon downstream resistance is created between the outlet and the inlet ports. However, in a vane pump, the rate of displacement of fluid volume is "positive" and has no direct relationship with differential pressure across the pump. The differential pressure does create a slip loss through the clearances between the rotor and the vanes and at the pumping vane/liner contact interface.

The constant radius arcs (pump arc and stop arc) are joined to each other by cycloidal arc curves. The cycloid arc shape can be produced with smooth points of tangency with the adjacent circular pump and stop arcs. The cycloidal shape is advantageous because the radial acceleration and velocity of the vane as it transcends through the change of radius is zero at the points of tangency at the intersections with the arcs of constant radius. The cycloidal arc shape produces a smooth acceleration curve which allows the vane to smoothly follow the cam shape. This eliminates jerk, shock, and vibration of the vane as it passes these points. Additionally a smooth acceleration curve aids in reducing slip loss (flow capacity losses caused by fluid passing between the vane and cam surface) and promotes uniform wear on contact surfaces.

Thus, the arcs connecting the constant radius arcs are dependent upon fluid capacity and geometric requirements and are designed non-symmetrically. The non-symmetrical arcs about the upstream-downstream seal axis allows at least two distinct advantages:

1. Non-symmetry allows by selective design, the extension of the cam profile to protrude further into the inlet cavity of the pump inlet. This feature maximizes the fluid volume that can be swept into the pumping chamber by the approaching vane thereby requiring a smaller volume of fluid make up to complete the filling of the pumping chamber. The inlet port is positioned further counter-clockwise (FIG. 1) into the pump arc to further increase fluid flow into the pumping chamber. This allows a longer period of time for suction. The smaller volume of fluid make up needed to complete the filling of the pump chamber and extended suction time lowers the head (force) requirements on the upstream fluid needed to complete the filling of the pump chamber, i.e., the larger the swept in volume, the smaller the mass of the make-up fluid volume, therefore, the lower the acceleration head (force) required. The pump's efficiency increases particularly in applications where low suction head is available.

2. Non-symmetry allows the discharge cycloidal arc to be shortened and the discharge fluid velocity controlled, particularly when transferring two phase fluids.

An additional improvement to the cam includes a relief/fill port system which is arranged at least partially in the pump arc and which connects the fluid in the pumping chamber with fluid at discharge pressure, i.e., fluid in the discharge system downstream of the outlet slots.

The relief/fill ports serve a number of functions:

1. In the liquid transfer of LPG and liquids that have high vapor pressures, two-phase (liquid-vapor) flow can be encountered in the inlet piping to the pump depending on the piping and tankage configuration and temperature of the fluid. When two-phase conditions occur, complete fluid filling of the pumping chamber becomes a thermodynamic impossibility. Filling the pump chamber through these ports prior to the leading vane porting to discharge produces a metering effect and reduces hydraulic shock.

2. The reverse function of "1" above is accomplished through these ports when complete filling of the pumping chamber has been achieved. Liquid passage through these ports to discharge is necessary to prevent physical lock-up of the rotor when transferring incompressible fluids. The relief function is necessary because of the slight compression on the pumping chamber volume before final porting to discharge (See feature D above).

3. Pressurization of the fluid in the pumping chamber through the relief/fill ports produces the hydraulic forces that extend the vane onto the cam profile and also push the pin drivers to load the opposing vane into the stop arc. Positive contact of the vanes to the pump arc and stop arcs reduces fluid slip over the vanes. The fluid from the discharge side of the pump energizes the liquid to extend the vane entering the pump chamber, i.e., the driving vane. Positive uniform contact of the vane to the cam profile increases the positive suction forces on the fluid following the vane into the pump chamber.

Immediately after the vane passes the inlet port, the driving vane is positively pushed by liquid differential pressure outward to seal against the pumping chamber arc of the cam. This assures a complete filling of the pump chamber between any two vanes; and exerting pressure on the driving vane reduces slip (fluid movement caused by the fluid pressure differential from discharge to suction) by closing the clearance at the vane-cam interface quickly as the vane passes the inlet port. This channel is particularly used when geometries require long pumping chamber arc length and where more than one vane is in the pump chamber.

The shorter discharge arc in conjunction with the relief/fill ports produces slight compression on the fluid to increase pumping chamber pressure insuring complete filling of the pumping chamber before porting to discharge. This produces a smooth and quiet discharge.

The discharge ports are also slotted; however, the arrangement of the slots can be arranged in a herringbone pattern. This shape provides an advantageous configuration to provide the continuous discharge porting, and balances forces caused by the discharge. This arrangement avoids the erratic flow and pressure patterns and geometric spacing problems associated with discharge holes. Additionally, the shape provides for uniform wear to occur on the vane because the slot "wipes" across a width of the vane as the vane passes over the slot. Parallel slots rather than herringbone slots can cause more localized wear to occur on the vane. The vane is also energized by the discharge pressure, and this pressure load on the back of the vane during discharge holds the vane tightly against the cam during fluid discharge.

As a further improvement to the vane pump, the thrust absorber bearing such as described by U.S. Pat. No. 3,392,677 has been improved. The redesigned thrust absorber utilizes a double row roller bearing that further reduces axial movement of the shaft that is caused by U-joint drives. The shaft of the pump has been shortened to end under this bearing. No portion of this shaft protrudes past the pivot point of the double row roller bearing to produce a bending moment or transmit an axial force.

BRIEF DESCRIPTION OF THE DRAWINGS

FIG. 3 is an elevational view of the liner of FIG. 1;

FIG. 5 is an elevational view of a vane pump connected to a driver;

DETAILED DESCRIPTION OF THE PREFERRED EMBODIMENTS

Figure 1:
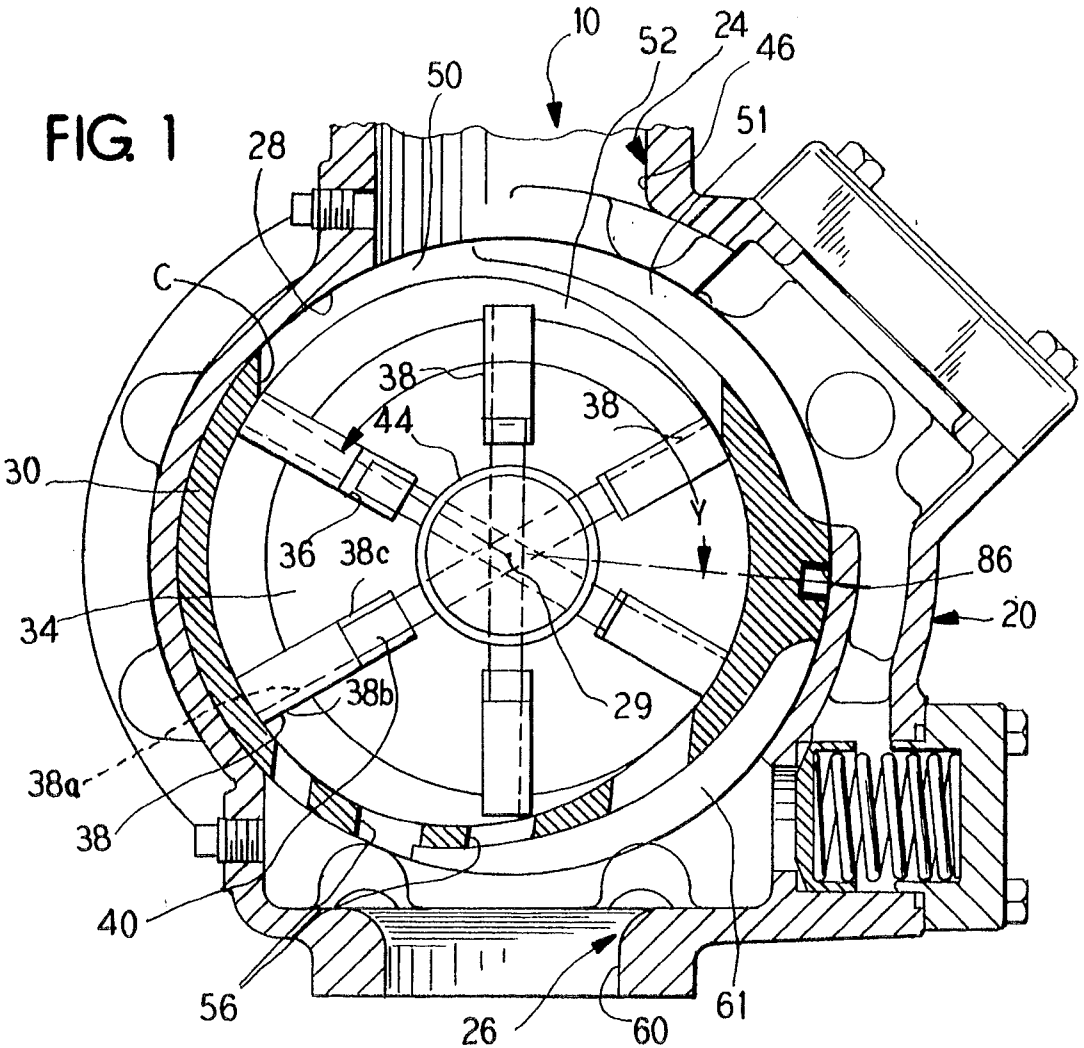
FIG. 1 is a cross sectional view of a vane pump of the present invention.

FIG. 1 shows a vane pump 10 comprising a casing 20 having an inlet 24 and an outlet 26. The casing 20 provides a cylindrical bore 28 which holds therein a cam or liner 30. A rotor 34 is mounted in axial alignment with the cylindrical bore 28 about an axis 29.

The rotor 34 comprises a plurality of slots 36 extending radially from a central area of the rotor 34 outward. Residing in the slots 36 are vanes or blades 38. The vanes 38 are biased outwardly by blade drivers or pins 40 which can be spring activated or which can be hydraulically actuated; U.S. Pat. No. 4,746,280 and 4,830,593 are herein incorporated by reference. The rotor 34 is mounted concentrically on a pump shaft 44. The pins 40 extend through the rotor into diametrically opposite slots 36. Each vane 38 has a channel **38*a* on a leading face 38*b* thereof which communicates fluid from outside the leading face 38*b* into a backside chamber 38*c*. Pressure in the backside chamber 38*c* drives the vane 38 outward and the pin 40 outward of the chamber 38*c*. Outward movement of the pin 40 drives out the respective opposite vane 38 from its slot 36**.

The inlet 24 comprises a nozzle 46 which feeds liquid into at least one slot 50 formed through the liner 30. A dished out chamber 51 on an outside of the liner 30 also receives liquid from the nozzle 46 and passes liquid through the slot 50. Once passing through the slot 50, liquid enters a moving volume 52 bounded by adjacent vanes 38, the rotor 34 and the liner 30. As the rotor rotates counterclockwise per FIG. 1, the volume 52 becomes larger due to the eccentric mounting of the rotor with respect to the liner and the select liner shape. In an area approximately diametrically opposite to the inlet slot 50 across the rotor is a series of outlet slots 56. When the moving volume 52 has rotated approximately opposite to the inlet region, the volume 52 opens into the outlet slots 56 for removal of the liquid out of a nozzle 60 directly, or into a dished out outlet chamber 61 which is in communication with the outlet 26 through the nozzle 60.

Figure 2:
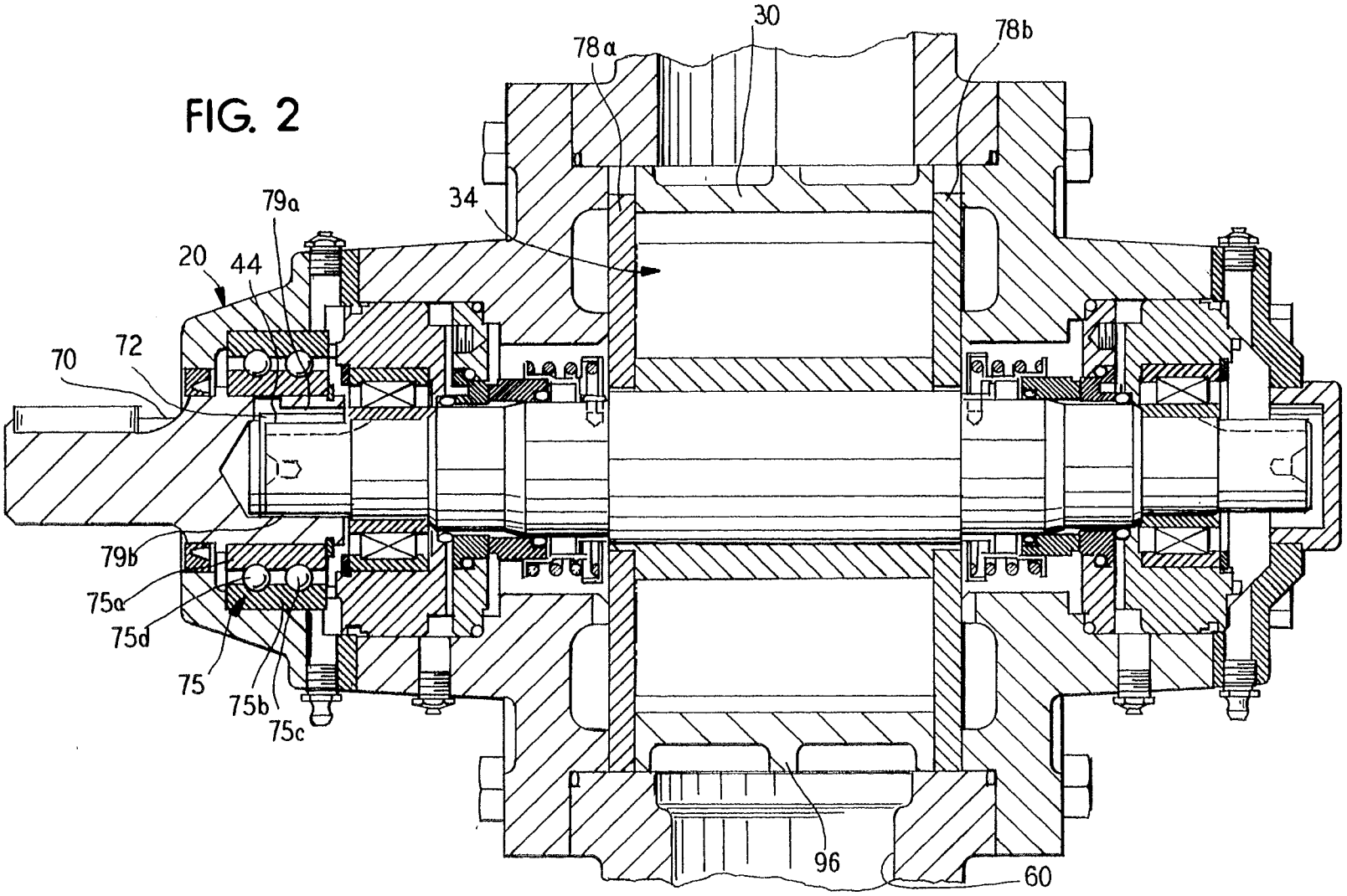
FIG. 2 is a longitudinal sectional view of the vane pump of FIG. 1.

FIG. 2 illustrates the mechanical arrangement of the pump 10 wherein a driver shaft 70 extends exterior of the casing 20 and is keyed via a shaft key 72 to the pump shaft 44. The pump shaft 44 and the driver shaft 70 are coupled within a thrust eliminator or double row roller bearing 75.

FIG. 5 shows the pump 10 mechanically connected to a driver 100 such as a power take-off from a truck. Typically, such power takes-offs are located elevated from the pump. A drive shaft 104 having U-joints 106 at opposite ends is used to drive the pump rotationally. Because of this offset, axial forces and bending movements can be transmitted through the pump input shaft 70. To alleviate these forces and movement, the inventive shaft and double row roller bearing arrangement described is utilized.

The thrust eliminator 75 developed for this pump is an improvement over the prior art. Several improvements are:

1. The known single row roller bearing is replaced with a double row roller bearing 75. The bearing 75 comprises an inner race **75*a*, an outer race 75*b*, an inboard circle of ball bearings 75*c*, and an outboard circle of ball bearings 75*d*. The double row roller bearing provides the capability to hold axial thrust loads. Axial thrust and cyclic forces are always present in power take-off drives that are commonly used on cargo tank trucks. Restriction of the axial movement is necessary to prevent the axial motion from being transmitted to the rotor-shaft assembly. The end clearances of the rotor to side plates 78*a*, 78*b*** are small, and axial movement of the rotor must be prevented to prevent galling and seizing of the rotor to the side plates during operation.

2. The axial engagement or overlap of the pump shaft 44 to the driver shaft 70 has been reduced. Minimizing the axial engagement of the shafts 44, 70 and not allowing the end **44*a* of the shaft to extend outboard of the outboard circle of ball bearings 75*d* limits outboard deflection that may be transmitted by the power takeoff drive being offset to the normal plane, as described with respect to FIG. 5**.

3. Clearances **79*a*, 79*b* at the keyed portion of the pump shaft 44, between the pump shaft 44 and the driver shaft 70 allow only the torsional forces delivered at the key to be transmitted. These clearances 79*a*, 79*b* are shown above the key 72 and below the pump shaft 44 in the particular rotational position shown in FIG. 2**.

FIG. 3 shows the liner 30 comprising a circular outside profile 80 and an asymmetrical inside profile 82. The liner 30 has at one side thereof a keyway 86 for proper positioning within the casing 20 which has a corresponding key. Per one shaping of the liner 30, Table 1 lists the inside dimensions measured counterclockwise around an inside sweep of the liner 30.

TABLE 1

| Angle From 0° ccw (deg) | Profile Dimension D, in. |
|---|---|
| 0 | 2.7180 |
| 30 | 2.7184 |
| 45 | 2.7402 |
| 60 | 2.8221 |
| 75 | 2.9640 |
| 90 | 3.1245 |
| 105 | 3.2493 |
| 120 | 3.3088 |
| 125 | 3.3156 |
| 180 | 3.3185 |
| 245 | 3.2931 |
| 260 | 3.2011 |
| 275 | 3.0468 |
| 290 | 2.8818 |
| 305 | 2.7657 |
| 320 | 2.7214 |
| 325 | 2.7184 |
| 330 | 2.7180 |

The cam profile is thus non-symmetrical as the profile is generated through two areas of constant radius: a stop arc sweeping across adjacent angles B, B'; and the pump arc, the point of maximum clearance and maximum vane extension, sweeping across equal and adjacent angles A, A. In the exemplary embodiment A=45°, B=25°, and B'=30°. The angle F between points of tangency moving from stop arc to pump arc is 110°. The cycloidal arcs connecting the constant radius areas are developed dependent upon the size geometry and required fluid flow capacity. The cam is constructed to produce the largest possible and practical fluid volume ahead of the pumping chamber that will be swept in by the vane.

Figure 4:
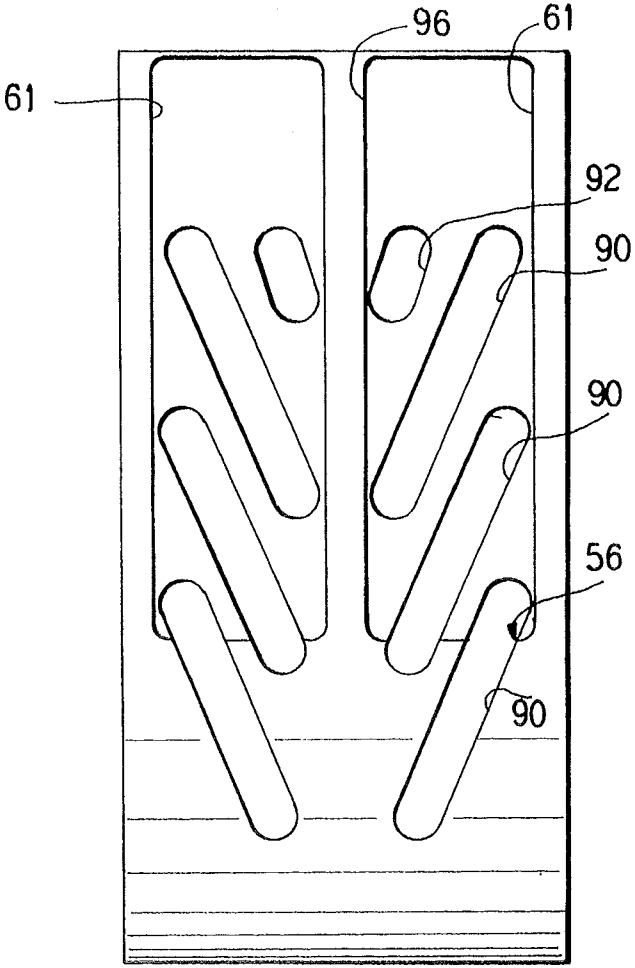
FIG. 4 is a side elevational view of the liner shown in FIG. 3.

FIG. 4 shows one outlet port 56 of the present invention. The outlet port 56 comprises a plurality of elongate slots 90 and a terminal slot 92 of shorter length than the elongate slots 90. A portion of the port 56 reside in the dished-out outlet chamber 61. The outlet chamber 61 is bisected by a circumferential ridge 96 which gives strength and rigidity to the liner 30 and increases surface contact area between the vanes and the liner to reduce wear. A herringbone arrangement of the slots 90, 92 provides an exemplary configuration to provide a continuous discharge port sweep across a width of the passing vane and balances the forces caused by the discharge. This avoids the erratic flow and pressure patterns and geometric spacing problems associated with holes. Additionally, the shape provides for uniform wear to occur on the vane. Parallel straight slots can cause increased local wear to occur on the vane compared to the herringbone pattern.

The vane 38 opening to the discharge ports 56 is energized by the discharge pressure through the channel 38*a*, and this pressure load from the backside chamber 38c of the vane during discharge holds the vane tightly against the cam during fluid discharges.

Referring back to FIG. 1, the inlet slot 50 terminates in a counterclockwise rotation at a point C oriented at an angle Y counterclockwise from a zero degree reference at the keyway 86. This point C is important to optimize the minimum net positive suction head it has been determined that this point is located according to the equations discussed below.

In a preferred embodiment, the angle Y is at least as great as an angle E (shown in FIG. 3) so that the slot 28 terminates at or into the circular pump arc A, A. This insures full extension of the vane 38 at the time it closes the moving volume 52 from the slot 50.

Figure 6:
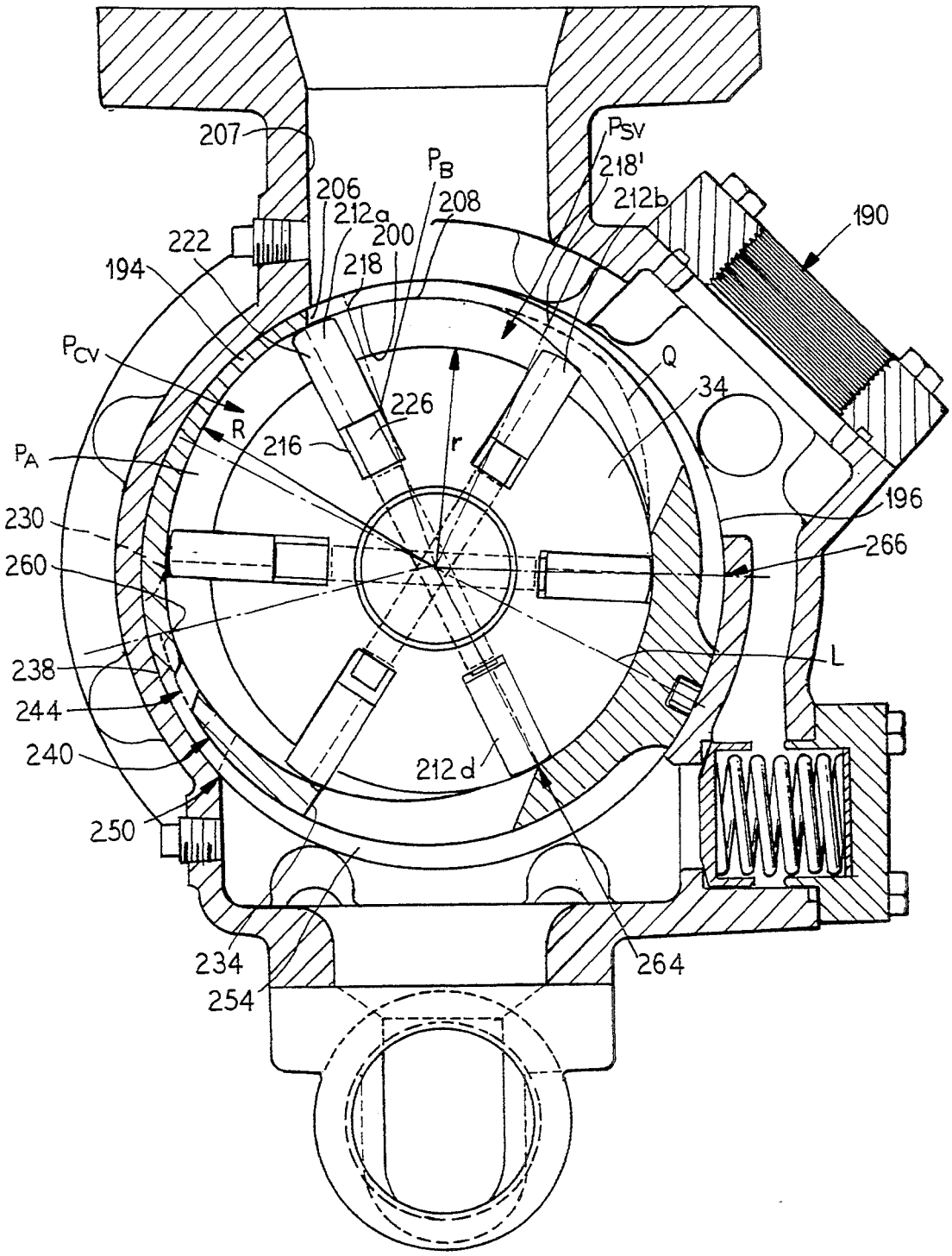
FIG. 6 is a cross sectional view of another vane pump of the present invention.

FIG. 6 illustrates another embodiment of a vane pump 190 having a modified cam or liner 194 which is rotated clockwise in the pump casing 196 as compared to the embodiment shown in FIG. 1. The modified liner 194 has an inside cam profile 200 which is described in more detail with regard to FIG. 10. The embodiment of FIG. 6 also includes relief/fill porting 230, 234, 236, 240, 244, and 248 described with regard to FIGS. 7 and 9. In the embodiment of FIG. 6, an inlet port cutoff 206 is arranged aligned with the inlet nozzle 207 which promotes fluid flow and reduces inlet pressure drop.

Figure 7:
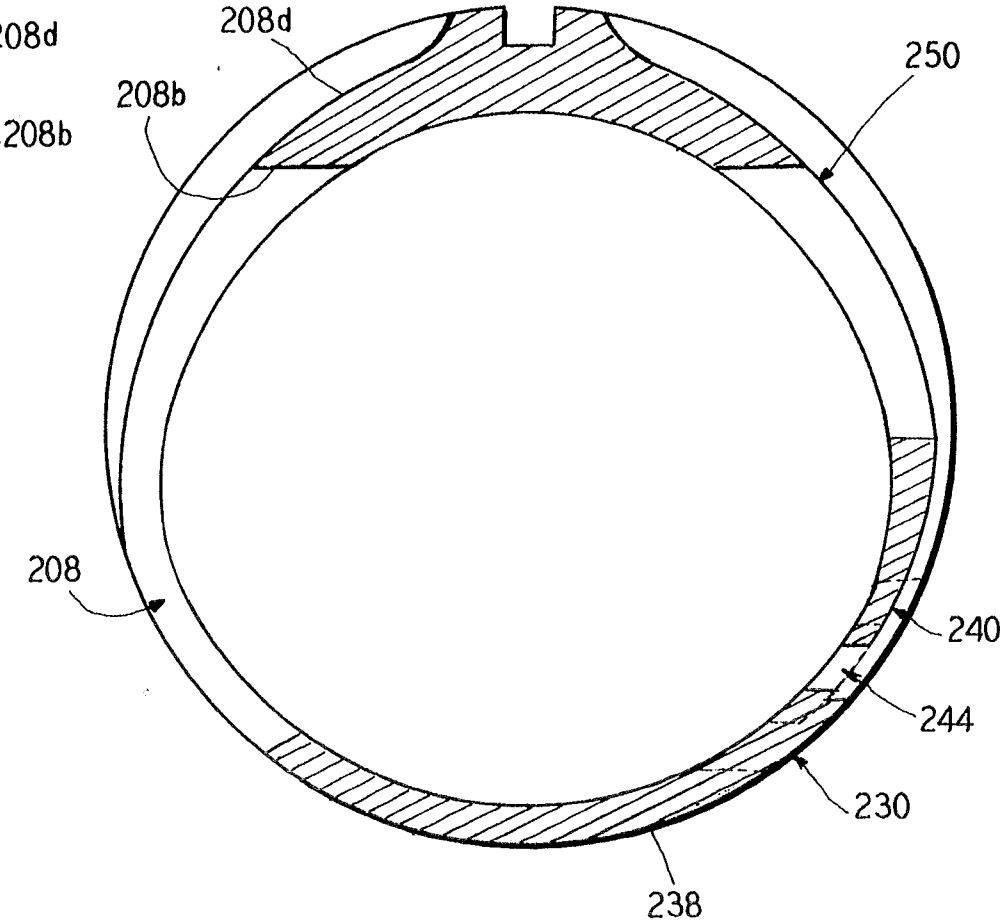
FIG. 7 is a sectional view of a liner used in the pump of FIG. 6.
Figure 8:
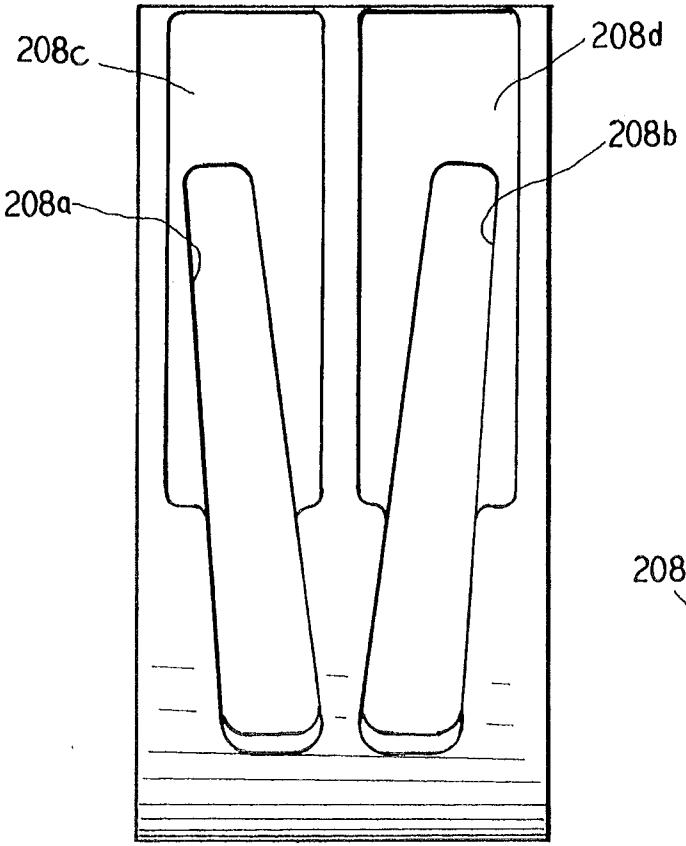
FIG. 8 is a left side elevational view of the liner shown in FIG. 7.
Figure 9:
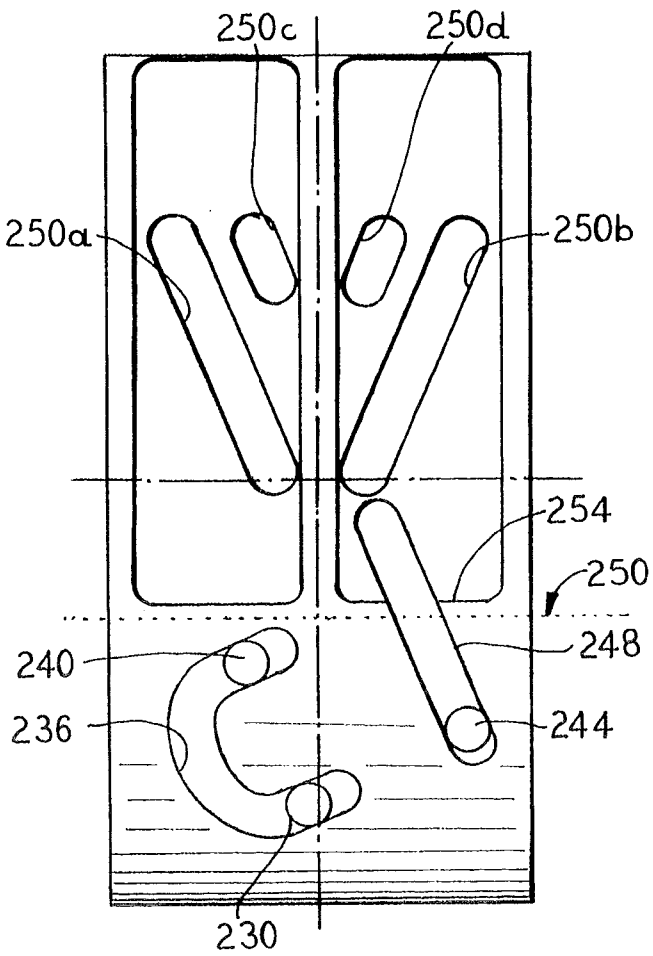
FIG. 9 is a right side elevational view of the liner shown in FIG. 7.

FIGS. 7, 8 and 9 illustrate the liner in more detail. The inlet 208 provides two slightly inclined through slots 208*a*, 208*b* residing partially in dished out parallel troughs 208*b*, 208*c*. The outlet 250 provides herringbone through slots 250*a*, 250*b*, 250*c* and 250*d*. The arrangement of the ports 230, 240, 244 and channels 236, 248 are illustrated in detail.

It is advantageous to energize the fluid in a pumping chamber Pcv by the discharge pressure created by the flow resistances in the downstream piping (resistances produced by valves and pipe friction). This pressure energy is also thus transferred to vane drivers 226. Energization occurs when a vane crosses the relief/fill port 230. Port 230 is interconnected to a discharge port 234 via a "C" configured channel 236, located on an exterior surface 238 of the cam, and a second relief/fill port 240 located at the top of the "C" channel 236 that joins the "C" channel to the discharge port 234. When the vane 212 crosses port 240, pumping chamber communication with the discharge is maintained by the relief/fill port 244. Port 244 is interconnected to the exterior surface of the cam 194 and communicates to the discharge through a straight line configured slot 248 that extends through a cam-case contact area 250 to the discharge cavity 254. The "C" channel 236 is covered by the pump case; the straight line slot 248 is directly connected to discharge. The ports 230 and 240 extend from an inside of the liner 194 into the "C" channel 236.

Figure 10:
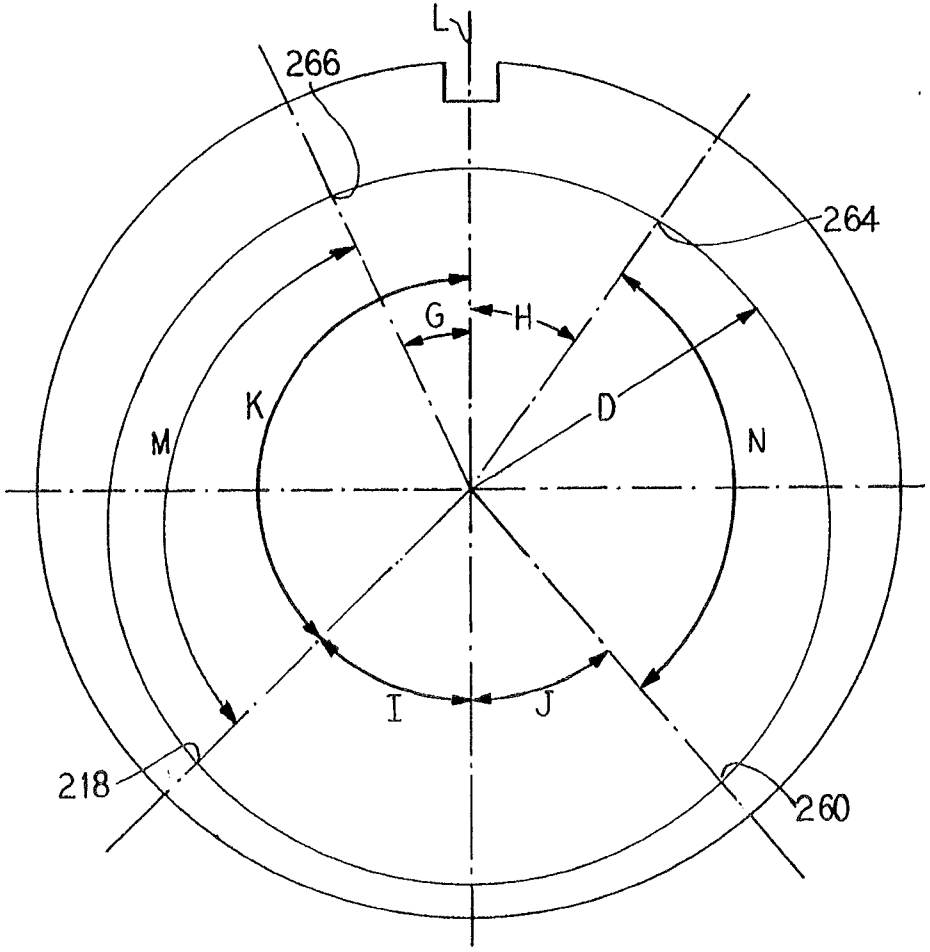
FIG. 10 is an elevational view of the liner shown in FIG. 7.

FIG. 10 illustrates the non-symmetrical configuration of the cam. The combined angle G and H is the stop arc and the combined angle I and J is the pump chamber. In this embodiment G=25°, H=35°, I=45°, J=40° and K=135°. Thus the cam is non-symmetrical with respect to the keyway axis L. The angle M is the inlet cycloidal arc and in this embodiment M=110°. The angle N is the outlet cycloidal arc and in this embodiment N=105°. Table 2 lists the inside dimensions measured counterclockwise around an inside sweep of the liner 194.

TABLE 2

| Angle From 0° ccw (deg) | Profile Radius R |
|---|---|
| 0 | 2.7180 |
| 30 | 2.7184 |
| 45 | 2.7402 |
| 60 | 2.8221 |
| 75 | 2.9640 |
| 90 | 3.1245 |
| 105 | 3.2493 |
| 120 | 3.3088 |
| 125 | 3.3156 |
| 180 | 3.3185 |
| 245 | 3.2708 |
| 260 | 3.1547 |
| 275 | 2.9897 |
| 290 | 2.8354 |
| 305 | 2.7434 |
| 320 | 2.7184 |
| 325 | 2.7180 |
| 330 | 2.7180 |

The derivation of the shape of the inside cam profile will now be explained with regard to FIGS. 6–13.

Referring to FIG. 6, a swept-in volume Psv of a "suction sweep" is bounded by the area contained between the inside cam profile 200 and the radius E of the rotor 34 in an arc starting with a lead vane 212*a* at the inlet port cutoff 206 extending clockwise across the inlet 208 and ending at the centerline of a trailing vane 212*b*. The pumping chamber volume Pcv extends through an arc starting at the inlet port cutoff 206 in the direction of the rotor-vane rotation (counter-clockwise) to the next leading vane 212*c* and is also bounded by the cam profile 200 and the radius r of the rotor. The pump chamber volume Pcv is larger than the swept-in volume Psv; and the balance of the fluid necessary to complete the filling of the pump chamber Pcv must be accomplished by the flow of the fluid in the time interval of the suction sweep, i.e., the time interval for the vane 212*b* to rotate to the position shown for vane 212*a*.

The suction sweep begins when the vane 212*a* crosses the inlet port cut-off 206. At this moment flow of fluid into the pump chamber Pcv ahead of the vane 212*a* is stopped, and the fluid velocity into the pump chamber Pcv becomes zero. As the vane 212*a* progresses in its counter-clockwise rotation, past the cut-off 206, the fluid volume required to fill the next forming pump chamber volume Pcv of liquid, in addition to the swept-in volume Psv, must have enough force applied to accelerate its mass to catch up with the vane 212*a* in the time allowed in the suction sweep (point where the following vane 212*b* meets the inlet port cutoff). If the fluid cannot catch up, the pumping chamber Pcv will be incompletely filled by the time the trailing vane 212*b* reaches the cut-off 206 causing the pressure in the chamber to be reduced below pump suction pressure. If the pumping chamber pressure falls below the fluid vapor pressure, vapor bubbles will form and cavitation will result during the collapse of those vapor bubbles in the power sweep. Incomplete filling of the pump chamber causes the discharge flow from the pump chamber to momentarily stop and/or reverse, producing a large fluid pulse and pressure hammer dependent upon pump speed and flow rates.

Proper location of the inlet cut-off 206 is critical. Complete fluid filling of a cavity 216 under the vane 212 is necessary as this fluid portion is also drawn in by the suction sweep. Full extension of the vane 212*b* occurs at the point of tangency 218 of cam profile 200, which is at the start of the pump arc and must occur before the inlet port cut-off 206. Final filling of this cavity 216 is accomplished through the fluid channels 222 located on the leading face of the vane 212 after the point of tangency 218 has been reached, i.e., full extension of the vane.

The design and location of the fluid inlet ports 208 considers the forces needed to produce the complete filling of the pump chamber. The location of the inlet port cut-off 206 with respect to the point of tangency 218 is optimized.

It is necessary to develop an understanding of pump inlet positive suction head requirements. One reference, *Pump Engineering Manual* from the Duriron Company, Inc., Chapter 5, Pages 62 through 66 explains the concept. The definition of "acceleration head" is understood by one skilled in the art and can be best found in the *Hydraulic Institute Standards,* pages 252 through 254, and on pages 1–16 and 1–17 in the *Cameron Hydraulic Data* published by Ingersoll-Rand.

The analysis of the energy required to overcome the effects of the reciprocating action of the crank slider mechanism of a reciprocating pump is similar to that for a rotary pump such as a vane pump, because both pumps are positive displacement machines. The fluid stops and starts each time a vane crosses the inlet port as it does in a reciprocating pump. If consideration is not given to this energy requirement, incomplete filling of the pump chamber occurs; and, with separation of the liquid, cavitation can occur dependent upon the fluid's vapor pressure.

The energy required to provide complete fill of the pump chamber is dependent upon the geometry describing the pump, the number of blades, and the speed at which the pump is running. It is helpful to assume that there is a water column standing in the pump inlet projected down into the approach chamber of the pump. The water column will be sliced each time a vane passes through the column and the sliced volume is carried into the pumping chamber, $P_{cv}$. The rate of these slices depends upon the number of blades that are in the pump and the speed at which the pump is operating. A displacement volume, is shape constricted and is equal to the total volume transferred per revolution divided by the number of blades. This displacement volume can be imagined as increments sliced out of the liquid column in chunks. The total volume of the annular piece of the pumping chamber between the liner and rotor is equal to the volume of the pumping chamber plus the volume required to fill-in under the trailing blade 212*b*.

The following example is illustrative. The total pump chamber volume, $P_{cv}$, is equal to 6.826 cubic inches, wherein $P_{cv}=P_a$ (volume of annular piece)$+P_B$ (volume under trailing vane). In the example, $P_a=5.552$ and $P_B=1.274$ ($P_{cv}=5.552+1.274$). The pump inlet is 3" in diameter having a cross section area, $A_i$, of 7.068 square inches. Dividing this number by the inlet volume, $P_{cv}$, finds the height of the incremental slice of liquid in the inlet line needed to fill the pumping chamber. Now imagine these slices being cut through and away from the column each time a vane passes through it. The stack of slices must fall 0.965 inches and reach the base of the column before the next vane cuts it away. If it cannot, incomplete filling of the pump chamber will result. The height of the increment can be identified to the length of the pump stroke. Using a design speed of 650 RPM and the 6 blade construction shown, the time required for a vane to pass through the column and for the water column to fall is 0.01538 seconds.

Given that the volume of the liquid increment in the column is equal to the pumping chamber volume, $P_{cv}$, the mass of the liquid increment is found:

$$M=\frac{P_{cv}\delta}{g}$$

$$M=\frac{(6.826\ \text{in}^3)(.036\#/\text{in}^3)}{32.2\ \text{ft/sec}^2}\cong .00765\ \frac{\#-\text{sec}^2}{\text{ft}}$$

Where:

M=mass, $$\frac{\#-\text{sec}^2}{\text{ft}}$$

$P_{cv}$=Pump Chamber Volume, in$^3$ $\delta^{cv}$=Density #/in$^3$ g=Acceleration of gravity, ft/sec$^2$ The energy required to move the incremental water volume (mass) down the column is first found by determining the acceleration that is required to move the incremental mass from a dead stop, a distance of 0.965 inches in 0.01538 seconds. This acceleration is equal to $$a=\frac{2L}{12\ t^2}=\frac{2\times .965}{12(.01538)^2}\cong 680\ \text{ft./sec}^2$$

Where:

a=Acceleration required of the mass, ft/sec$^2$

L=Length of stroke, ft t=Time at suction, sec

Using Newton's Second Law, F=ma, and the above conditions of acceleration and mass, the force required at the base of the water column to push down the incremental volume in time for the next sweep of the following vane is calculated. This force, F, is as follows:

$$F=Ma=0.0076\times 680=5.202\ \text{pounds force}$$

The pressure, psi, at the bottom of the water column can be determined by dividing the force, F, by the projected cross-sectional area of the water column:

$$P = \frac{F}{A} = \frac{5.202}{7.068} = .736 \text{ psi}$$

Since water weighs 62.37 pounds/cubic foot at 60° F. a one-foot water column will result in 0.433 pounds/-square inch pressure force at its base.

Conversion of the pressure force, P, into "feet of head," derives how many feet of "water" column needs to be maintained above the base of the column to provide the energy needed to move the mass of liquid down to achieve full filling of the pumping chamber without separation in the water column. This requirement is also identified as an energy loss and is named "acceleration head", $H_a$:

$$H_a = \frac{P}{433} \approx 1.7 \text{ ft of water column}$$

This analysis assumed an ideal inlet geometry for minimum $H_a$ and is dependent upon the assumed operating speed and geometry profile. To achieve this optimum, the perfect inlet radius to the approach of the pumping chamber was set equal to the pump chamber radius, and the point of tangency was theoretically rotated clockwise to establish a full pump chamber constant radius across the base of the water column.

Moving the point of tangency clockwise to the point of intersection of the water column and retaining a cycloidal arc from a point of tangency 266 at the stop arc to a point of tangency 218' at the pump arc, is possible. This is shown in FIG. 6 with the tangency point 218' and cycloidal arc Q shown dashed. However, following this arc Q puts an abrupt lift into the path of the vane **212*b* when passing from the stop arc to pump arc. The smaller angle between the tangency point 218' and the point of tangency 266 at the end of the constant radius stop arc, results in a reduction of time required for the vane to make the transition between the two radii, stop arc and pump arc, and increased radial movement required of the blade driver to maintain contact. These are detrimental features that must be considered. To do this, a compromise or an optimization is derived, i.e., the tangent point is moved counter-clockwise from the point 218' to the point of tangency 218** by optimizing minimum $H_a'$ (described below) and minimal detrimental effects due to an abrupt transition between stop arc and pump arc.

The following analysis assumes there are no fluid acceleration requirements prior to the fluid entering the pump chamber. The mass of the fluid to be accelerated is the differences between the pump chamber volume Pcv and the swept-in volume Psv, and the velocity of the fluid is zero at the beginning of the suction sweep.

The analysis assumes that the fluid is at rest throughout the inlet. When the suction sweep begins, the total mass of the fluid to be accelerated is small; therefore, the required force is small. However, as the suction sweep proceeds, the mass to be accelerated increases as does the required force. The force required to provide complete filling will be determined by using the average mass of the fluid over the time of the suction sweep. When the suction sweep begins, the tip velocity of the vane is dependent upon rotor speed and the velocity of the fluid is zero. Therefore, there must be enough force available to accelerate the fluid mass so that it can catch up with the vane by the end of the suction sweep. If it does not, there will be incomplete pump chamber filling; pump chamber pressures can fall below the vapor pressure of the fluid, and the fluid will cavitate (i.e., the fluid boils). Cavitation, dependent upon degree, creates large downstream pressure fluctuations that will be accompanied with corresponding vibration and noise.

The placement of the inlet port was driven by a unique application of Newtonian physics, both fluid and thermodynamic.

The acceleration required of the fluid is calculated from the length of stroke, and the force is calculated from Newton's Laws, particularly Law II, i.e., F=Ma, and the reaction to that force, Law III: "The forces of action and reaction between contacting bodies are equal in magnitude, opposite in direction, and collinear," i.e. P=F/A. Algebraically, the solution is as follows:

$$M' = \frac{(P_{cv} - P_{sv})\delta}{g}$$

where:

M'=incremental mass of liquid to fill Pcv $$\frac{\# - \sec^2}{\text{ft}}$$

$P_{cv}$=Pump Chamber Volume, $ft^3$ $P_{sv}$=Swept Volume, $ft^3$

δ=Density $\#/ft^3$ g=Acceleration of gravity, $ft/sec^2$;

and $$a = \frac{2L}{t^2}$$

where:

a=Acceleration required of the mass, $ft/sec^2$

L=Length of stroke $$\text{ft} = \frac{2\pi R}{N}, \text{ ft}$$

t=Time at suction, sec;

R=Pump arc radius

N=Number of vanes in rotor and $$F = M'a = \left[\frac{(Pcv - Psv)\delta}{g}\right]\left(\frac{2L}{t^2}\right)$$

$$P = \frac{F}{A} = \left[\frac{(Pcv - Psv)\delta}{g}\right]\left(\frac{2L}{t^2}\right)\left(\frac{1}{A}\right)$$

Where:

P=The reaction pressure exerted on the fluid by the accelerating force, F, psi; and A=bh Where:

A=Cross sectional areas normal to the accelerating force, F, $in^2$ b=Length of vane (into the page of FIG. 6), in.

h=Height of the pumping chamber, in; so $$P = \left[\frac{(Pcv - Psv)\delta}{g}\right]\left(\frac{2L}{t^2}\right)\left(\frac{1}{bh}\right)$$

The calculated reaction pressure, P, in psi, can be converted into pressure head, $H'_a$, in feet:

$$H_a' = \frac{P \times 144}{\delta} = \frac{(Pcv - Psv) \times 144\ 2L}{g\ t^2\ \text{bh}}$$

However, $$t = \frac{60}{\text{RPM}(2\pi N)}\text{, sec;so}$$

$$H_a' = \left[\frac{(Pcv - Psv) \times 144}{g}\right]\left(\frac{2L}{\frac{60}{\text{RPM}(2\pi N)}}\right)^2\left(\frac{1}{bh}\right)\text{, or}$$

$$H_a = P_{cv}\frac{(1 - P_{sv}/P_{cv})\bar{r}\theta_{PC}}{gt^2} = 0$$

$$\text{LIM } P_{sv} \rightarrow P_{cv}$$

Where:

RPM=Pump revolutions per minute, $H'_a$=Incremental acceleration head due to Psv being less than Pcv.

e,ovs r×=average radius of the pump chamber, and $\Theta_{pc}$=angle of one pump stroke (angle between vanes)

Acceleration head is the largest component of the total net positive suction head requirements of the pump.

$H_a$ is speed (time) dependent as acceleration is exponential, and the mass is linear in their impact in the calculation. This analysis was used in the pump design to create optimum geometries.

As the above equation for $H'_a$ demonstrates, $H'_a$ is minimum where $P_{sv} \rightarrow P_{cv}$. Where $P_{sv}=P_{cv}$ $H'_a$=O. To do the optimizing for minimum $H_a'$ an analysis of the detrimental effects of an abrupt cycloidal arc between the stop arc and the pump arc needs to be undertaken. The smaller angle between the points of tangency 218' and 266 results in a reduction of time required for the vane (blade) to make the transition between the two radii and increased radial movement required of the blade driver is needed to maintain contact. This causes an unrealistic path for the blade to follow. If the blade is not in contact with the cam during the suction stroke, fluid slips over the top of the vane. Therefore, the benefit of having the suction chamber volume equal to the pump chamber volume with respect to the acceleration head is negated if the blade cannot follow the resulting path.

Thus, the optimal point of pump arc tangency, or the angle M, represents a compromise between minimum $H_a'$ and minimum slip loss. It is necessary to define the curve representing the loss of capacity due to slip over the top of the blade. The free path of the blade is defined as it moves through the suction stroke. The blade is subjected to the forces, as shown on FIG. 12, which have a resulting force causing the blade to move in its free path.

The free path is defined:

$$r = \frac{1}{2}at^2 + r_o \tag{1}$$

where r is the radial path transversed by the tip of the blade with respect to the rotor centerline (feet);

a is the acceleration of the blade (feet per second squared);

t is the time it takes for blade to transverse its radial path (seconds);

$r_o$ is the stop radius (feet); and $$t = \frac{\theta}{\omega} \tag{2}$$

where $\theta$ is the angle of the blade at some given point with respect to the stop tangency (radians);

$\omega$ is the pump speed (radians per second); and substituting equation (2) into equation (1) derives:

$$r = \frac{1}{2}a\left(\frac{\theta}{\omega}\right)^2 + r_o \tag{2a}$$

From Newton's second law, the resulting acceleration of the blade is defined:

$$a = \frac{\Sigma F}{\Sigma M} = \frac{F_{PD} - F_{PS} + F_C - F_L - F_{MC} - F_F}{M_B + M_P} \tag{3}$$

where $F_{PD}$ is the force of the, discharge pressure on the pin to the blade (lbs);

$F_{PS}$ is the force of the suction pressure on the pin to the blade (lbs);

$F_C$ is the centrifugal force on the blade (lbs);

$F_L$ is the force required to draw fluid into the space vacated by the extending blade (lbs);

$F_{MC}$ is the minimum contact force required for the blade to penetrate the viscous fluid boundary layer $L_{BL}$ (lbs);

$F_F$ is the friction forces on the blade (lbs);

$M_B$ is the mass of the blade (lbm);

$M_P$ is the mass of the pin (lbm); and (4) $F_{PD}-F_{PS}=(P_D-P_S)A_P=P_{Diff}A_P$ where $P_D$ is the discharge pressure (PSIG);

$P_S$ is the suction pressure (PSIG);

$P_{Diff}$ is the differential pressure or discharge pressure minus suction pressure (PSIG);

$A_P$ is the cross sectional area of the pin (square inches); and (5) $F_C=M_BR\omega^2$ where R is the assumed path at the center of the mass of the blade (feet). Note the path is assumed to be linear with respect to the rotor centerline such that:

$$R = R_o + \frac{R_f - R_o}{\theta_{SP}}\theta \tag{6}$$

where $R_o$ is the initial distance of the center of the mass of the blade with respect to the rotor center-line (feet);

$R_f$ is the final distance of the center of the mass of the blade with respect to the rotor centerline (feet);

$\theta_{SP}$ is the angle between the pump chamber radius tangency and the stop radius tangency (radians).

Substituting equation 6 into equation 5 derives:

$$F_C = M_B\omega^2\left(R_o + \frac{R_f - R_o}{\theta_{SP}}\theta\right) \tag{7}$$

(8) $F_L = \Delta P_L(A_b)$ where $\Delta P_L$ is the pressure required to fill the void with liquid created by the extending blade (PSIG); and $A_b$ is the projected area of the blade (square inches); and $$\Delta P_b = SG\left(\frac{Q}{C_{VB}}\right)^2 \tag{9}$$

where

Q (GPM) is the void to be filled in time, TEB (minutes);

SG is the specific gravity of the liquid;

$C_{VB}$ is the flow coefficient of the channels in the blade.

Q at some $\theta$ is assumed to be linear as shown by:

$$Q = \frac{\Delta V}{\Delta t} \tag{10}$$

where $\Delta$ V (gallons) is the void under the blade at some $\theta$.

$\Delta$ V is assumed to increase linearly by the following:

$$11.\ \Delta V = \left(\frac{V_{EB}}{\theta_{SP}}\right)\theta$$

where $V_{EB}$ is the total volume of the blade extended past the rotor or the total void created by the extending blade.

Again, $$t = \frac{\theta}{\omega},$$

but since this must be in minutes:

$$t_{EB} = \frac{t}{60} = \frac{\theta}{\omega(60)} \tag{12}$$

Substitute equations (11) and (12) into equation (9) derives:

$$13.\ Q = \frac{\left(\frac{V_{EVB}\theta}{\theta_{SP}}\right)}{\left(\frac{\theta}{\omega(60)}\right)} = \frac{V_{EB}\omega(60)}{\theta_{SP}}$$

The $C_{VB}$ for the channels in the blade can be found in Crane Bulletin 410 for an area of 0.376 inches squared.

Substituting equation (12) into equation (9) then into equation (8) derives:

$$F_L = SG(A_b)\left(\frac{V_{EB}\omega 60}{C_{VB}\theta_{SP}}\right) \tag{14}$$

$F_{MC}$ was taken from previous empirical data with a pump speed of 650 RPM, at 70° F. in propane with 0.0005" blade tip clearance where:

(15) $F_{MC} \approx 82$ lbs; and

(16) $F_F = \mu\ (F_{N1} + F_{N2})$;

where $F_{N1}$ is the normal force on the trailing edge of the blade to the rotor slot due to force ($F_M$) required to sweep the mass of the liquid through the suction chamber; and $F_{N2}$ is the normal force on the leading edge of the blade to the rotor slot due to force ($F_M$) required to sweep the mass of the liquid through the suction chamber; and

(17) $F_M = \Delta M a_L$ where $\Delta$M is the mass of liquid being swept at some $\theta$ ($lb_m$);

$a_L$ is the acceleration of the liquid through the suction chamber.

$\Delta$M is assumed to vary linearly as defined by the following:

$$\Delta M = \frac{M_{PC}\theta}{\theta_{SP}} \tag{18}$$

where $M_{PC}$ is the mass of the liquid in the pump chamber.

$$a_L = \frac{2L}{t_{PC}^2} \tag{19}$$

where

L is the average arc length of one stroke of the pump; and $t_{PC}$ is the time required for that stroke.

(20) $L = \bar{r}\omega$ where $\bar{r}$ is the average radius of the pump chamber; and $$t_{PC} = \frac{\theta_{PC}}{\omega} \tag{21}$$

where $\theta_{PC}$ is the angle of one pump stroke such as 60°.

Substituting equations (18), (19), (20) and (21) into equation 17 derives:

$$F_M = \frac{M_{PC}\theta(2\bar{r}\omega)\omega}{\theta_{SP}(\theta_{PC})} = \frac{M_{PC}\theta(2\bar{r})\ \omega^2}{\theta_{SP}(\theta_{PC})} \tag{22}$$

Figure 13:
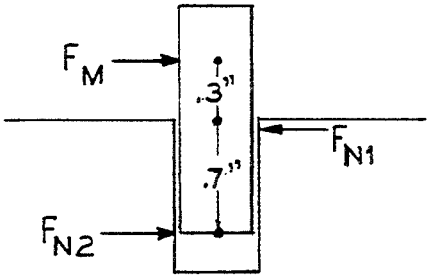
FIG. 13 is a further schematic diagram explaining the selection of the angle between tangency points.

FIG. 13 shows a blade at full extension subjected to the force $F_M$ wherein:

(23) $\Sigma F = 0$, $F_M + F_{N2} = F_{N1}$ and

(24) $\Sigma M_o = 0$, $F_M(0.03) = F_{N2}(0.7)$

Solving equations 23 and 24 simultaneously derives:

$$F_{N2} = \frac{3}{7}F_M = \frac{3M_{PC}\theta(2\bar{r}\omega^2)}{7\theta_{SP}\theta_{PC}} \tag{25}$$

-continued $$F_{N1} = \frac{10}{7} F_M = F_{N1} = \frac{10 M_{PC}\theta(2\bar{r}\omega^2)}{7\theta_{SP}\theta_{PC}} \quad (26)$$

Substituting equations (25) and (26) into equation (16) derives:

$$F_F = \frac{\mu 13(M_{PC}\theta)(2\bar{r}\omega^2)}{7\theta_{SP}\theta_{PC}} \quad (27)$$

Substituting equations (4) , (7) , (14) , (15) , and (27) into equation (3) then into (2a) derives:

$$\rightarrow r = \theta^2 \left( \frac{P_{diff}(A_P) + M_B\omega^2\left(R_o + \frac{(R_f - R_o)\theta}{\theta_{SP}}\right) - SG(A_b)\left(\frac{V_{EB}\omega 60}{C_{VB}\theta_{SP}}\right) - F_{MC} - \frac{\mu 13 M_{PC}\theta(2\bar{r})\omega^2}{7(\theta_{SP})\theta_{PC}}}{2\omega^2(M_B + M_P)} \right) + r_o \quad (28)$$

The above equation is iterated until the curve converges to a single function. From this last equation, a curve is generated by incrementing the angle between the pump arc and stop arc points of tangencies. These incremental points are plotted against a swept in volume due to the blade action defined by this last equation divided by the pumping chamber volume.

Figure 11:
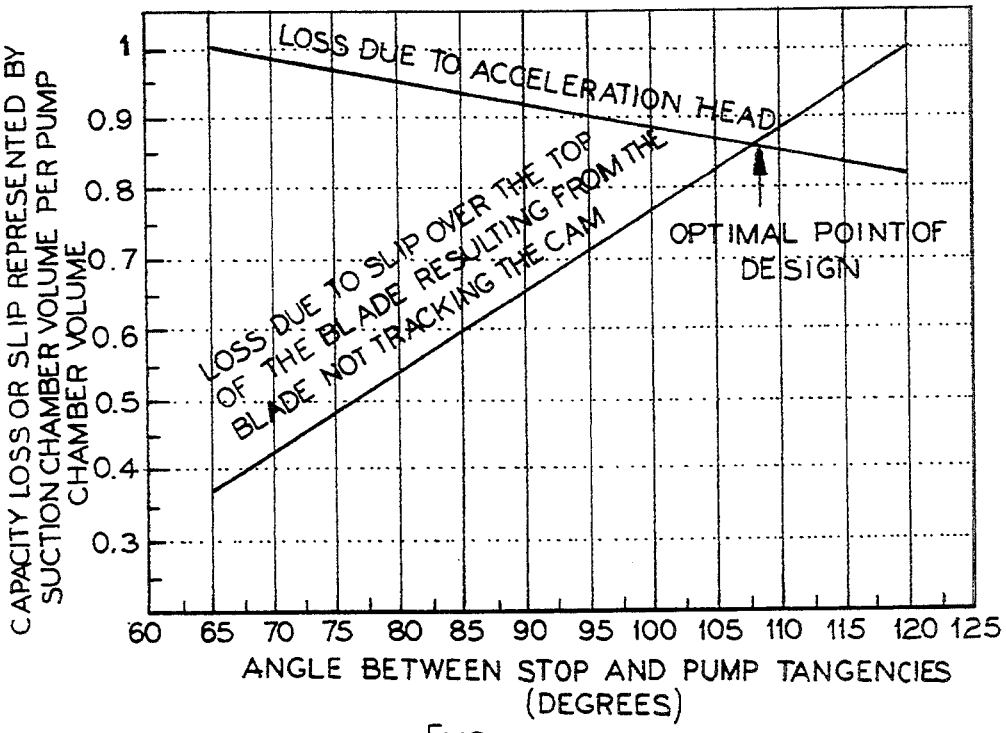
FIG. 11 is a graph explaining the selection of the angle between tangency points.
Figure 12:
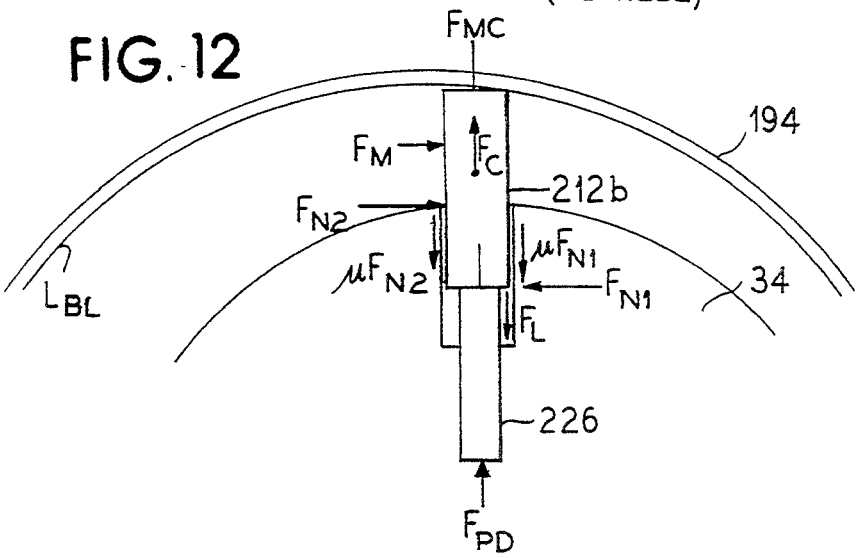
FIG. 12 is a schematic diagram explaining the selection of the angle between tangency points.

A graphical representation of the solution showing the relationship of the angle between the pump arc and stop arc with respect to the loss of capacity due to acceleration head and slip over the top of the blade is shown in FIG. 11. This graphical solution is for a six vane, 650 RPM pump such as for propane at approximately 70° F.

As shown in FIG. 11, as the angle M between the pump chamber radius and the stop radius tangencies increase, the loss due to the acceleration head increases, that is an increased $H'_a$ because of a reduced $P_{SV}$. However, the blade is more able to track the cam in the suction stroke resulting in lower slip over the top of the blade and lower capacity loss. It is hypothesized that these two causes of capacity loss have curves that intersect at a point. This point defines the theoretical optimal angle between the stop arc and pump arc.

The value of 110 degrees in the design of the above described example pump was used to match machine tool software capability and is considered to be the maximum for the particular application. The point of tangency is considered to be nominal with a ±3° tolerance. Where the inlet cut-off 206 is 180° diametrically opposed to the beginning of the stop arc at tangency port 264, and the stop arc is equal to the angular distance between adjacent blades, this sets the inlet cut-off 206 angularly with respect to the tangency point 266, and thus the selection of the optimal angle M between tangency points also sets the optimal Psv. In the developed example, the angle between tangency point 266 and inlet cut-off 206 is between 118°–120°.

Non-symmetry also allows the discharge arc, defined from the tangent point 260 to the tangent point 264, to be shortened. This feature allows control of the discharge fluid by providing a slight compression of the fluid before discharging which promotes reliquification of any vapor remaining in the pump chamber.

As illustrated in FIG. 6, the stop arc located between the tangent points 264, 266, the first cycloidal arc located between the tangent points 266 and 218, the pump arc located between the tangent points 218 and 260, and the second cycloidal arc located between the tangent points 260 and 264 are sized and arranged such that while one blade is within the pump arc upstream of the first port 230, another blade is always within the stop arc. This insures a sealing and balancing across a hypothetical sealing division line between the suction and discharge sides of the pump. This hypothetical sealing line corresponds to the center line L of the cam 194. As demonstrated in FIG. 6, when the vane 212a is aligned with the cut-off point 206, a vane 212d is aligned with the beginning of the stop arc, the tangency point 264. In this embodiment then, the minimum stop arc is equivalent to the arc distance between adjacent vanes, that is 60°, and the optimum cycloidal arc begins at tangency point 266 and extends to the tangency point 218 which provides the optimum swept in volume $P_{SV}$ for operation of the pump.

Although the present invention has been described with reference to a specific embodiment, those of skill in the art will recognize that changes may be made thereto without departing from the scope and spirit of the invention as set forth in the appended claims.

I claim as my invention:

1. A sliding vane pump for pumping a fluid having a liquid portion comprising:

a housing having a fluid inlet channel for receiving a fluid having a liquid portion and a fluid outlet channel for discharging a fluid having a liquid portion;

a rotor mounted rotatably within said housing, said rotor having a plurality of vanes proceeding radially from a center hub in sliding fashion;

a liner having a continuous wall interfit into said housing between an inside surface of said housing and said rotor, said liner comprising an inlet opening through said wall in communication with said inlet channel of said housing and at least one outlet opening through said wall in communication with said outlet channel of said housing, said rotor mounted eccentrically with respect to an inside surface of said liner, said vanes extendable from said hub to maintain moving contact with said inside surface of said liner;

wherein said liner has an inside liner profile with a suction arc transitioning into a pump arc which defines a region of maximum radial clearance between said hub and said liner, and said inlet opening is arranged extending in an arc around a partial outside perimeter of said liner from said suction arc into said pump arc.

2. The sliding vane pump according to claim 1, wherein said pump arc has a first constant radius curvature bounded by said suction arc, and comprising a discharge arc, said discharge arc and said suction arc having mathematically non-symmetrical curvatures.

3. The sliding vane pump according to claim 2, wherein said liner profile comprises a fourth section bounded by said mathematically non-symmetrical sections, said fourth section having a second constant radius curvature smaller than said first constant radius curvature, said first and second constant radius curvatures having the same center point.

4. A sliding vane pump comprising:

a housing having an inlet channel and an outlet channel;

a rotor mounted rotatably within said housing, said rotor having a plurality of vanes proceeding radially from a center hub in sliding fashion;

a liner comprising a continuous wall interfit into said housing between an inside surface of said housing and said rotor, said liner comprising an inlet slot through said wall in communication with said inlet channel of said housing and at least one outlet slot through said wall in communication with said outlet channel of said housing, said rotor mounted eccentrically with respect to an inside surface of said liner, said vanes extendable from said hub to maintain moving contact with said inside surface of said liner, wherein said liner has an inside liner profile with a pump arc region defining a region of maximum radial clearance between said hub and said liner and said inlet slot is arranged around a partial perimeter of said liner into said region of maximum radial clearance;

wherein said inside surface of said liner has an inside liner profile having a first section having a constant radius bounded by two sections having mathematically non-symmetrical curvatures, said region of maximum radial clearance located between said first section and said hub;

wherein said liner profile comprises a fourth section bounded by said mathematically non-symmetrical sections, said fourth section having a second constant radius smaller than said first section, said first and fourth sections having the same center point;

wherein said second constant radius approximates a radius of said center hub for close fit between said center hub and said fourth section; and said inlet slot terminating in said first section at a point 180° diametrically opposed to said intersection of said third and fourth sections and said fourth section spans an angle approximately equal to the angular distance between adjacent vanes.

5. A sliding vane pump comprising:

a housing having an inlet channel and an outlet channel;

a rotor mounted rotatably within said housing, said rotor having a plurality of vanes proceeding radially from a center hub in sliding fashion;

a liner comprising a continuous wall interfit into said housing between an inside surface of said housing and said rotor, said liner comprising an inlet slot through said wall in communication with said inlet channel of said housing and at least one outlet slot through said wall in communication with said outlet channel of said housing, said rotor mounted eccentrically with respect to an inside surface of said liner, said vanes extendable from said hub to maintain moving contact with said inside surface of said liner, wherein said liner has an inside liner profile with a pump arc region defining a region of maximum radial clearance between said hub and said liner and said inlet slot is arranged around a partial perimeter of said liner into said region of maximum radial clearance; and wherein said at least one outlet slot comprises a plurality of outlet slots arranged in a herringbone pattern.

6. A sliding vane pump for pumping a fluid having a liquid portion comprising:

a housing having a fluid inlet channel for receiving a fluid having a liquid portion and a fluid outlet channel for discharging a fluid having a liquid portion;

a rotor mounted rotatably within said housing about a centerline, said rotor having a plurality of vanes proceeding radially from a cylindrical center hub in sliding fashion;

a liner having an inside surface, interfit into said housing between an inside surface of said housing and said rotor, said liner comprising an inlet opening in communication with said inlet channel of said housing and an outlet opening in communication with said outlet channel of said housing, said vanes extendable from said hub to maintain moving contact with said inside surface of said liner, said inside surface of said liner having an inside profile having a first section having a first constant radius about said centerline bounded by second and third sections having non-symmetrical cycloidal arc curvatures and a fourth section connected to said first section by said second and third sections, said fourth section having a second constant radius about said centerline, less than said first constant radius.

7. The sliding vane pump according to claim 6, wherein said second constant radius of said fourth section is approximately equal to a radius of said cylindrical center hub and said fourth section defines a stop arc;

said inlet opening comprises at least one slot arranged extending through said liner located in said second section and said first section.

8. The sliding vane pump according to claim 6, further comprising pins extendable from said hub beneath said vanes, the vanes having fluid channels to pass fluid beneath said vanes for fluid pressure to extend said pins to force out said vanes toward said liner, and wherein a swept-in volume is defined as that volume circumscribed by adjacent vanes, a radial surface of the hub, and a portion of the liner between the vanes, throughout a depth of the pump, when a lead vane is located at a cut-off of the inlet opening; and said intersection point of the first and second sections is located upstream of the inlet opening cut-off, located at the point which geometrically maximizes the swept-in volume, but said swept-in volume limited by a vane swept-in volume defined by extension of a trailing vane according to an equation:

$$r = \theta^2 \left( \frac{P_{diff}(A_P) + M_B\omega^2 \left( R_o + \frac{(R_f - R_o)\theta}{\theta_{SP}} \right) - SG(A_b) \left( \frac{V_{EB}\omega 60}{C_{VB}\theta_{SP}} \right) - F_{MC} - \frac{\mu 13 M_{PC}\theta(2\bar{r})\omega^2}{7(\theta_{SP})\theta_{PC}}}{2\omega^2(M_B + M_P)} \right) + r_0$$

where:

r is the radial extension by a tip of a trailing vane, $\theta$ is the angular position of the trailing vane with respect to the intersection between the fourth and second sections, $P_{diff}$ is the difference between a discharge pressure of said vane pump and a suction pressure of said vane pump, $A_P$ is the cross sectional area of a pin, $M_B$ is the mass of a vane, $\omega$ is the rotational pump speed, $R_o$ is an initial distance of the center of mass of the vane with respect to a rotor centerline, $R_f$ is a final distance of the center of the mass of the vane with respect to the rotor centerline, $\theta_S$ is the angular extent of the second section between the first and fourth sections, SG is the specific gravity of the liquid being pumped, $A_b$ is the projected area of the vane, $V_{EB}$ is the volume of the vane which is extended from the hub, $C_{VB}$ is a flow coefficient of the channels in a vane, $F_{MC}$ is a minimum contact force required for the vane to penetrate a viscous fluid boundary layer of the fluid being pumped, $\mu$ is a friction coefficient of the liquid being pumped, $M_{PC}$ is a mass of the liquid being pumped within the pump chamber, $\bar{r}$ is the average radius of the pump chamber, $\theta_{PC}$ is an angle between adjacent vanes, $M_P$ is a mass of a pin.

9. A sliding vane pump comprising:

a housing having an inlet channel and an outlet channel;

a rotor mounted rotatably within said housing about a centerline, said rotor having a plurality of vanes proceeding radially from a cylindrical center hub in sliding fashion;

a liner having an inside surface, interfit into said housing between an inside surface of said housing and said rotor, said liner comprising an inlet opening in communication with said inlet channel of said housing and an outlet opening in communication with said outlet channel of said housing, said vanes extendable from said hub to maintain moving contact with said inside surface of said liner, said inside surface of said liner having an inside profile having a first section having a first constant radius about said centerline bounded by second and third sections having non-symmetrical cycloidal arc curvatures and a fourth section connected to said first section by said second and third sections, said fourth section having a second constant radius about said centerline, less than said first constant radius;

wherein said second constant radius of said fourth section is approximately equal to a radius of said cylindrical center hub and said fourth section defines a stop arc;

said inlet opening comprises at least one slot arranged extending through said liner located in said second section and said first section; and wherein said plurality of vanes comprises six vanes arranged at 60° spacing around said hub;

said second section spans approximately 110° about said centerline.

10. The sliding vane pump according to claim 9, wherein said inlet slot extends into said first section from said second section by approximately 8°–13°.

11. The sliding vane pump according to claim 10, wherein an intersection between said third section and said fourth section is 180° diametrically opposite a termination of said said inlet opening, and said stop arc is approximately equal to the angular spacing between two adjacent blades.

12. The sliding vane pump according to claim 9, wherein said first section spans approximately 85° about said centerline.

13. A sliding vane pump comprising:

a housing having an inlet channel and an outlet channel;

a rotor mounted rotatably within said housing, said rotor having a plurality of vanes proceeding radially from a center hub in sliding fashion;

a liner having an inside surface interfit into said housing between an inside surface of said housing and said rotor, said liner comprising an inlet opening in communication with said inlet channel of said housing and an outlet opening in communication with said outlet channel of said housing, said vanes extendable from said hub to maintain moving contact with said inside surface of said liner, said outlet opening comprising parallel rows of slots inclined from an arcuate line of sweep of said vanes against said liner.

14. The sliding vane pump according to claim 13, wherein each slot overlaps a respective adjacent slot along the arcuate line of sweep.

15. A sliding vane pump comprising:

a housing having an inlet channel and an outlet channel;

a rotor mounted rotatably within said housing, said rotor having a plurality of vanes proceeding radially from a center hub in sliding fashion;

a liner having an inside surface interfit into said housing between an inside surface of said housing and said rotor, said liner comprising an inlet opening in communication with said inlet channel of said housing and an outlet opening in communication with said outlet channel of said housing, said vanes extendable from said hub to maintain moving contact with said inside surface of said liner, said outlet opening comprising a plurality of slots extended in an arcuate line of sweep of said vanes against said liner.

16. The sliding vane pump according to claim 15, wherein said slots are inclined with respect to said arcuate line of sweep.

17. A sliding vane pump comprising:

a housing having an inlet channel and an outlet channel;

a rotor mounted rotatably within said housing about a centerline, said rotor having a plurality of vanes proceeding radially from a cylindrical center hub in sliding fashion;

a liner having an inside surface interfit into said housing between an inside surface of said housing and said rotor, said liner comprising an inlet opening in communication with said inlet channel of said housing and an outlet opening in communication with said outlet channel of said housing, said vanes extendable from said hub to maintain moving contact with said inside surface of said liner, said inside surface of said liner having an inside profile having a first section having a first constant radius about said centerline bounded by second and third arc sections, and a fourth section having a second constant radius about said centerline, less than said first constant radius;

wherein said outlet opening is located through said third section and said first section comprises a segment located about said centerline from said inlet opening and extending around in a direction of rotor rotation in an arc length equal to the angular spacing between adjacent vanes which defines a closed pumping chamber defined between adjacent vanes, the hub and the liner; and wherein said liner comprises a port means downstream of said segment in the direction of said rotor rotation and upstream of said outlet opening, in the rotation direction of said rotor, said port means opening a side of said liner opposite said housing to fluid pressure from said outlet channel.

18. The sliding vane pump according to claim 17, wherein said port means comprises a first port through said liner, a second port downstream of said first port through said liner, and a C-shaped channel connecting said first and second ports; and a third port through said liner at a position downstream of said first port and upstream of said second port, in the rotation direction of said rotor, said third port piercing said liner and connected to a flow channel in flow connection with said outlet channel.

19. The sliding vane pump according to claim 17, wherein said port means is located at approximately the intersection between said first section and said third section.

20. The sliding vane pump according to claim 17, wherein said port means comprises a first port through said liner at approximately the intersection between said first section and said third section, a second port through said liner located downstream of said first port in a direction of rotor rotation, and a first flow channel connecting said first port and said second port formed on an outside surface of said liner, and a third port through said liner located between said first port and said second port in a rotation direction of said rotor, and a second flow channel flow connecting said third port to said outlet channel.

21. The sliding vane pump according to claim 20, wherein said first flow channel comprises a C-shaped channel.

22. A sliding vane pump comprising:

a housing having an inlet channel and an outlet channel;

a rotor mounted rotatably within said housing, said rotor having a plurality of vanes proceeding radially from a center hub in sliding fashion;

said rotor mounted axially onto a pump shaft extending axially therefrom;

an input shaft connected to said pump shaft axially and extending outside said housing;

said input shaft connected to said pump shaft via a socketed key connection;

a roller bearing surrounding said socketed key connection wherein an outward termination of said pump shaft is located within the axial confines of the roller bearing; and a liner having an inside surface interfit into said housing between an inside surface of said housing and said rotor, said liner comprising an inlet opening in communication with said inlet channel of said housing and an outlet opening in communication with said outlet channel of said housing, said vanes extendable from said hub to maintain moving contact with said inside surface of said liner.

23. The sliding vane pump according to claim 22, wherein said roller bearing comprises two rows of ball bearings arranged between an inner race and outer race, said rows axially spaced apart, and said outward termination of said pump shaft is located between said two rows of ball bearings.

24. The sliding vane pump according to claim 22, wherein said socketed key connection provides radial clearances between said input shaft and said pump shaft allowing only torque to be transmitted between said input shaft and said pump shaft.

25. A sliding vane pump comprising:

a housing having an inlet channel and an outlet channel;

a rotor mounted rotatably within said housing about a centerline, said rotor having a plurality of vanes proceeding radially from a cylindrical center hub in sliding fashion;

a liner having an inside surface interfit into said housing between an inside surface of said housing and said rotor, said liner comprising an inlet opening in communication with said inlet channel of said housing and an outlet opening in communication with said outlet channel of said housing, said vanes extendable from said hub to maintain moving contact with said inside surface of said liner, said inside surface of said liner having an inside profile having a first section having a first constant radius about said centerline bounded by second and third arc sections, and a fourth section having a second constant radius about said centerline, less than said first constant radius;

wherein said outlet opening is located through said third section and said first section comprises a segment located about said centerline from said inlet opening and extending around in a direction of rotor rotation in an arc length equal to the angular spacing between adjacent vanes, said segment, said hub and said adjacent vanes define a closed pumping chamber at an initial position; and a port means located ahead of said closed pumping chamber when at said initial position, and upon further rotation of said closed pumping chamber along said first section of said inside profile of said liner, flow connecting said closed pumping chamber with a pressurized volume defined between the leading vane of said closed pumping chamber and an advanced vane which leads said leading vane in a direction of rotation of said rotor.

26. The sliding vane pump according to claim 25, wherein said port means comprises a first port open within said first section to a hub side of said liner, and a channel formed extending through said liner circumferentially, and a second port downstream of said first port, within said third section and open to said hub side of said liner and penetrating said liner, said channel flow connecting said first and second ports.

27. The sliding vane pump according to claim 26 further comprising a third port arranged circumferentially between said first port and said second port, said third port penetrating through a thickness of said liner and connected to a second channel open to said outlet opening.

28. A sliding vane pump for pumping a fluid having a liquid portion comprising:

a housing having a fluid inlet channel for receiving a fluid having a liquid portion and a fluid outlet channel for discharging a fluid having a liquid portion;

a rotor mounted rotatably within said housing, said rotor having a plurality of vanes proceeding radially from a center hub in sliding fashion;

a liner comprising a continuous wall interfit into said housing between an inside surface of said housing and said rotor, said liner comprising an inlet slot through said wall in communication with said inlet channel of said housing and at least one outlet opening through said wall in communication with said outlet channel of said housing, said rotor mounted eccentrically with respect to an inside surface of said liner, said vanes extendable from said hub to maintain moving contact with said inside surface of said liner;

wherein said liner has an inside liner profile with a pump arc defining a region of maximum radial clearance between said hub and said liner and said liner oriented with said inlet slot terminating in substantial alignment with an inside wall of said inlet channel for substantially straight flow from said inlet channel into said inlet slot; and said region of maximum radial clearance bounded by two non-symmetrical cycloidal arc regions.

29. A sliding vane pump according to claim 28, wherein said inlet slot is arranged extending around a partial outside perimeter of said liner into said region of maximum radial clearance.

30. A sliding vane pump for pumping a fluid having a liquid portion comprising:

a housing having a fluid inlet channel for receiving a fluid having a liquid portion and a fluid outlet channel for discharging a fluid having a liquid portion;

a rotor mounted rotatably within said housing, said rotor having a plurality of vanes proceeding radially from a center hub in sliding fashion;

a liner comprising a continuous wall interfit into said housing between an inside surface of said housing and said rotor, said liner comprising an inlet slot through said wall in communication with said inlet channel of said housing and at least one outlet slot through said wall in communication with said outlet channel of said housing, said rotor mounted eccentrically with respect to an inside surface of said liner, said vanes extendable from said hub to maintain moving contact with said inside surface of said liner, wherein said liner has an inside liner profile with a suction arc defining a suction chamber region having an increasing radial clearance between said liner and said hub, said suction arc transitioning into a pump arc defining a region of maximum radial clearance between said hub and said liner; and wherein said fluid inlet channel and said inlet slot are arranged for substantial straight fluid flow into said suction chamber region and said inlet slot arranged extending in an arc around a partial outside perimeter of said liner from said suction arc into said pump arc of said pump.

31. A sliding vane pump for pumping a fluid having a liquid portion comprising:

a housing having a fluid inlet channel for receiving a fluid having a liquid portion and a fluid outlet channel for discharging a fluid having a liquid portion;

a rotor mounted rotatably within said housing, said rotor having a plurality of vanes proceeding radially from a center hub in sliding fashion;

a liner comprising a continuous wall interfit into said housing between an inside surface of said housing and said rotor, said liner comprising an inlet slot through said wall in communication with said inlet channel of said housing and at least one outlet slot through said wall in communication with said outlet channel of said housing, said rotor mounted eccentrically with respect to an inside surface of said liner, said vanes extendable from said hub to maintain moving contact with said inside surface of said liner, wherein said liner has an inside liner profile with a suction arc defining a suction chamber region having an increasing radial clearance between said liner and said hub, said suction arc transitioning into a pump arc defining a region of maximum radial Clearance between said hub and said liner;

wherein said fluid inlet channel and said inlet slot are arranged for substantial straight fluid flow into said suction chamber region and partially into said region of maximum radial clearance of said pump; and wherein said pump arc comprises a first circular arc, said liner comprises a circular stop arc, said suction arc comprises a cycloidal arc, and said liner comprising a second cycloidal arc connecting said first circular arc with said circular stop arc and said fluid inlet channel comprises a width substantially equal to a width of said suction arc.

32. The sliding vane pump according to claim 31, wherein said inlet channel comprises a width substantially equal to a spacing between adjacent vanes.

33. A sliding vane pump comprising:

a housing having an inlet channel and an outlet channel;

a rotor mounted rotatably within said housing, said rotor having a plurality of vanes proceeding radially from a center hub in sliding fashion;

a liner comprising a continuous wall interfit into said housing between an inside surface of said housing and said rotor, said liner comprising an elongate inlet slot through said wall in communication with said inlet channel of said housing and at least one outlet slot through said wall in communication with said outlet channel of said housing, said rotor mounted eccentrically with respect to an inside surface of said liner, said vanes extendable from said hub to maintain moving contact with said inside surface of said liner, wherein said liner has an inside liner profile with a suction arc transitioning into a pump arc which defines a region of maximum radial clearance between said hub and said liner and said elongate inlet slot is arranged around a partial perimeter of said liner into said region of maximum radial clearance.

34. The sliding vane pump according to claim 33, wherein said pump arc has a first constant radius curvature bounded by said suction arc, and comprising a discharge arc, said discharge arc and said suction arc having mathematically non-symmetrical curvatures.

35. The sliding vane pump according to claim 34, wherein said liner profile comprises a fourth section bounded by said mathematically non-symmetrical sections, said fourth section having a second constant radius curvature smaller than said first constant radius curvature, said first and second constant radius curvatures having the same center point.

* * * * *

UNITED STATES PATENT AND TRADEMARK OFFICE

CERTIFICATE OF CORRECTION

PATENT NO. : 5,431,552

DATED : July 11, 1995

INVENTOR(S) : Ronald A. Schuller, et al

It is certified that error appears in the above-indentified patent and that said Letters Patent is hereby corrected as shown below:

On the title page, Item [75] Inventors, change "Tietenbrun" to —Tiefenbrun—.

At column 8, line 52, please change "radius E" to --radius r--.

At column 13, line 31, please change "e,ovs rX" to --$\bar{r}$ --.

At column 14, line 35, please change "the, discharge" to --the discharge--.

At column 16, first formula, please change "$\left(\frac{V_{EB}\omega 60}{C_{V_B}\theta_{SP}}\right)$" to --$\left(\frac{V_{EB}\omega 60}{C_{V_B}\theta_{SP}}\right)^2$--.

At column 16, line 9, please change "≈82 lbs;" to --≈8 lbs;--.

At column 16, line 62, please change "$F_M(0.03)$" to --$F_M(0.3)$--

Signed and Sealed this

Nineteenth Day of December, 1995

*Attest:*

*Attesting Officer*

BRUCE LEHMAN

*Commissioner of Patents and Trademarks*